US005121690A

United States Patent [19]

Yamaguchi et al.

[11] Patent Number: 5,121,690

[45] Date of Patent: Jun. 16, 1992

[54] PLATE BASE FIXING STRUCTURE

[75] Inventors: Ryuta Yamaguchi; Tohru Takamura, both of Tokyo, Japan

[73] Assignee: Kabushiki Kaisha Shinkawa, Tokyo, Japan

[21] Appl. No.: 556,038

[22] Filed: Jul. 20, 1990

[30] Foreign Application Priority Data

Jul. 22, 1989 [JP] Japan ..... 1-189227

[51] Int. Cl.[5] ..... B41F 27/00

[52] U.S. Cl. ..... 101/389.1

[58] Field of Search ..... 101/389.1, 390, 391, 101/382.1

[56] References Cited

U.S. PATENT DOCUMENTS

| | | | |
|---|---|---|---|
| 1,395,328 | 11/1921 | Adams | 101/389.1 X |
| 2,060,082 | 11/1936 | Johnson et al. | 101/389.1 X |
| 2,417,496 | 3/1947 | Huebner | 101/389.1 X |
| 3,353,481 | 11/1967 | Antonucci | 101/389.1 X |

*Primary Examiner*—Clifford D. Crowder
*Attorney, Agent, or Firm*—Koda and Androlia

[57] ABSTRACT

A plate base fixing structure including positioning pins provided on either a plate base or plate base fixing block, positioning holes provided in one of the two members which has no positioning pins, the positioning pins being inserted the positioning holes, and a negative-pressure suction hole opened in the plate base fixing block so that the suction hole lets the negative pressure pass to the plate base fixing block. Thus, the plate base is mounted on the plate base fixing block by suction adhesion obtained as a result of the negative pressure.

1 Claim, 1 Drawing Sheet

PLATE BASE FIXING STRUCTURE

FIELD OF THE INVENTION

The present invention relates to a plate base fixing structure used in a marking device.

PRIOR ART

Conventional plate base fixing structure is shown in FIG. 3. A plate base fixing block 1 is moved up and down by a driving means (not shown), and a plate base 3 is fixed to this block 1 via a tightening bolt 4. On the plate base 3 is attached a relief printing plate 2 which is made of rubber, etc. Reference numeral 5 is a bolt holder which is interposed between the plate base 3 and the bolt 4, and reference numeral 6 is a nut which prevents loosening of the bolt 4.

Positioning of the plate base 3 with respect to the plate base fixing block 1 is accomplished as follows: positioning in the X direction (i.e., the horizontal direction) is accomplished by causing a taper surface 3*a* of the plate base 3 to contact a dovetail groove 1*a* formed in the plate base fixing block 1, and positioning in the Y direction (the direction perpendicular to the accompanying drawing paper) is accomplished by causing the surface of the plate base 3 to contact a stopper 7 which is installed inside the plate base fixing block 1.

PROBLEMS TO BE SOLVED BY THE PRESENT INVENTION

In the conventional technique, positioning in the X and Y directions is accomplished by causing surfaces of the plate base 3 to contact the dovetail groove 1*a* and stopper 7 of the plate base fixing block 1. Thus, the plate base 3 tends to float upward as a result of one-sided contact, resulting in difficulty obtaining horizontal positioning of the relief plate attachment surface of the plate base 3. Furthermore, the plate base 3 is first positioned separately in the X and Y directions. Then, the plate base 3 is held in place with one hand so that the plate base 3 does not shift its position. The plate base 3 is then fixed with the other hand using the bolt 4 and nut 6. Accordingly, the fastening error can be large, and precision of only about 0.1 mm can be obtained. Manufacturing of the plate base fixing block 1 and plate base 3 is complicated, and the manufacturing cost is high.

The object of the present invention is to provide a plate base fixing structure which allows high-precision positioning, superior in terms of working characteristics, and inexpensive to manufacture.

MEANS TO SOLVE THE PROBLEMS

The object of the present invention is accomplished by: installing positioning pins on either one of the plate base and plate base fixing block; opening positioning holes, into which the positioning pins are inserted, in the other of these two members; and installing a negative-pressure suction hole in the plate base fixing block, which passes negative pressure to the plate base attachment surface of the plate base fixing block. The plate base is thus fixed to the plate base fixing block by suction adhesion obtained as a result of the negative pressure.

FUNCTION

Since the plate base and plate base fixing block are positioned by means of positioning pins and positioning holes, the fastening error is small, and high-precision positioning is obtained. Since the plate base can be mounted and dismounted by switching the negative pressure applied to the plate base attachment surface of the plate base fixing block "on" and "off", the attachment work can be performed in a short period of time. Since no complicated processing work is required, the manufacturing cost is low.

DETAILED DESCRIPTION OF THE INVENTION

Figure 1:
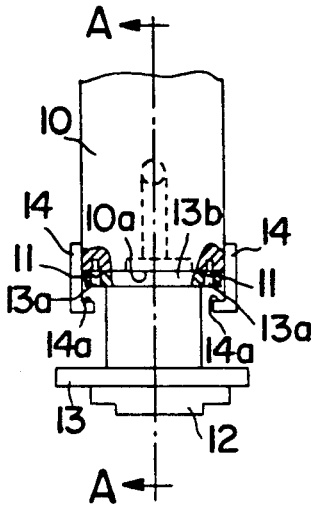
FIG. 1 is a front view illustrating one embodiment of the present invention.
Figure 2:
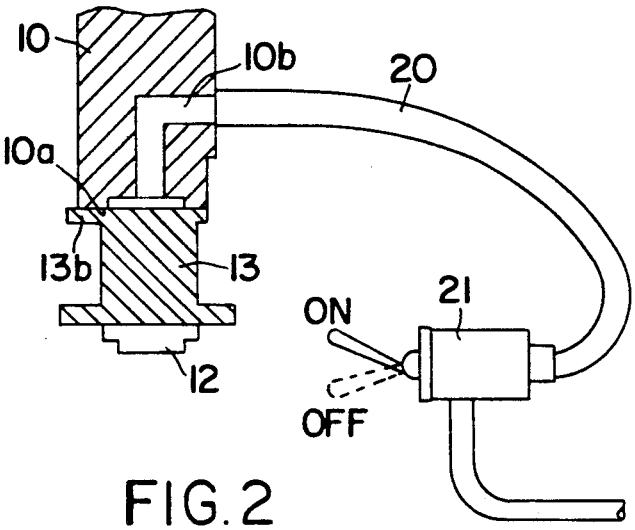
FIG. 2 is a cross section taken along line A—A in FIG. 1.
Figure 3:
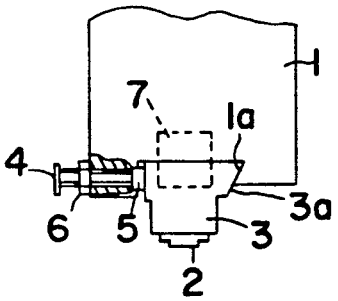
FIG. 3 PRIOR ART
FIG. 3 is a front view of a conventional device.

Two positioning pins 11 are fastened to the plate base attachment surface 10*a* of a plate base fixing block 10 which is moved up and down by a driving means (not shown). A plate base 13, to which a relief printing plate 12 is attached has positioning holes 13*a*, and the positioning pins 11 are inserted in these holes 13*a*. Plates 14 are fastened to the left and right side surfaces of the plate base fixing block 10 so that the plates 14 prevent the plate base from dropping. The distance between the plate base attachment surface 10*a* of the plate base fixing block 10 and the receiving surfaces 14*a* of the plates 14 that prevent dropping of the plate base is set greater than the distance that is obtained by adding the thickness of the flange part 13*b* of the plate base 13 to the length the positioning pins 11 project from the plate base attachment surface 10*a*.

The plate base fixing block 10 is provided with a negative-pressure suction hole 10*b*, and this hole 10*b* connects with the plate base attachment surface 10*a*. One end of piping tube 20 is connected to this negative-pressure suction hole 10*b*, and a negative-pressure on-off switch 21 is provided at the middle of this piping tube 20. The other end of the piping tube 20 is connected to a negative pressure supply source (not shown).

The mounting of the plate base 13 to the plate base fixing block 10 will be described below: With the negative-pressure on-off switch 21 switched "off", the flange part 13*b* of the plate base 13 to which a relief printing plate 12 is attached is inserted, in the direction perpendicular to the accompanying drawing paper, into the gap between the plate base attachment surface 10*a* of the plate base fixing block 10 and the receiving surfaces 14*a* of the plates 14 which prevents the plate base from dropping. Then, the positioning holes 13*a* of the plate base 13 are aligned with the positioning pins 11, and the plate base 13 is lifted upward. Thus, the plate base 13 contacts the plate base attachment surface 10*a* of the plate base fixing block 10. When the negative-pressure on-off switch 21 is switched "on" in this state, negative pressure acts on the negative-pressure suction hole 10*b* of the plate base fixing block 10 via the piping tube 20. As a result, the plate base 13 is fixed to the plate base attachment surface 10*a* of the plate base fixing block 10 by suction adhesion.

The plate base 13 may be dismounted from the plate base fixing block 10 in the following manner: By switching the negative-pressure on-off switch 21 "off," the negative pressure ceases to act on the negative-pressure suction hole 10*b* of the plate base fixing block 10. Accordingly, the plate base 13 drops by its own weight and is held by the plates 14 which prevent the plate base from dropping. Then, it is merely necessary to pull out the plate base 13.

As described above, the plate base 13 is positioned by fitting the positioning holes 13*a* over the positioning pins 11. The fastening error in this case consists only of the dimensional tolerances of the positioning pins 11 and positioning holes 13*a*. Accordingly, precision on the order of approximately 0.01 mm may be expected. Mounting and dismounting of the plate base 13 can be accomplished by merely switching the negative-pressure on-off switch 21 which switches the negative pressure "on" and "off." Thus, the work efficiency is increased and the cost of manufacturing can be reduced.

In the embodiment described above, though the plates 14 are employed for preventing the dropping of the plate base, it is possible to omit the plates 14. However, dropping of the plate base 13 caused by operational mistakes, etc. can be prevented by installing the plates 14. Since the plate base 13 can be supported on the plates 14 temporarily, work efficiency is superior. Also, the positioning pins 11 and positioning holes 13*a* are in a male-female relationship. Accordingly, it is possible to install the positioning pins 11 on the plate base 13 and to form the positioning pins 13*a* in the plate base fixing block 10. In the embodiment described above, two positioning pins 11 and two positioning holes 13*a* are used. However, it is possible to use three or more pins and positioning holes.

EFFECT OF THE INVENTION

As is clear from the above description, according to the present invention, positioning pins are provided on either the plate base or plate base fixing block, and the positioning holes into which the positioning pins are inserted are provided either on the plate base fixing block or plate base. Also, a negative-pressure suction hole is provided in the plate base fixing block, which passes negative pressure to the plate base attachment surface of the plate base fixing block. With this structure, the plate base is mounted to the plate base fixing block by suction adhesion as a result of the negative pressure. High-precision positioning is possible, the work efficiency is excellent and the manufacturing costs are low.

I claim:

1. A plate base fixing structure for use in a marking device characterized in that said structure comprises:

a flat printing plate mounting plate base for mounting a printing plate thereon;

a mounting flange provided on said printing plate mounting plate base on an end opposite a printing plate mounting end;

a plate base fixing block;

positioning holes provided in one of said mounting flange of said printing plate mounting plate base and said plate base fixing block;

positioning pins in an other of said mounting flange of said printing plate mounting plate base and said plate base fixing block with said positioning pins inserted in said positioning holes;

plate base drop preventing plate provided on opposite sides of said plate base fixing block, each of said plate base drop preventing plates being "L" shaped in cross-section with a long leg of said "L" shape being fixed to said plate base fixing block and a short leg of said "L" shape defining a receiving surface with a distance between an attachment surface of the plate base fixing block and said receiving surface being greater than the distance comprising a thickness of the mounting flange added to a length of said positioning pins; and a negative-pressure suction hole provided in said plate base fixing block for passing negative pressure to said plate base fixing block, whereby said printing plate mounting plate base is fixed to said plate base fixing block by suction adhesion obtained as a result of said negative pressure.

* * * * *